US005289657A

United States Patent [19]

Kiel

[11] Patent Number: 5,289,657

[45] Date of Patent: Mar. 1, 1994

[54] REFRIGERATOR GASKET AND RETAINER

[75] Inventor: Lowell M. Kiel, Seymour, Ind.

[73] Assignee: The Standard Products Company, Cleveland, Ohio

[21] Appl. No.: 851,424

[22] Filed: Mar. 13, 1992

[51] Int. Cl.[5] ..... E06B 7/16

[52] U.S. Cl. ..... 49/478.1; 49/484.1; 49/489.1; 49/493.1; 49/498.1

[58] Field of Search ..... 49/475, 478, 488, 489, 49/493, 495, 498, DIG. 1

[56] References Cited

U.S. PATENT DOCUMENTS

| | | | |
|---|---|---|---|
| 3,078,134 | 2/1963 | Haynes | 49/495 X |
| 3,137,900 | 6/1964 | Carbary | 49/478 X |
| 3,353,321 | 11/1967 | Heilweil et al. | 49/478 X |
| 3,378,957 | 4/1968 | Frehse | 49/478 X |
| 3,378,958 | 4/1968 | Parks et al. | 49/495 X |
| 3,448,543 | 6/1969 | Multer | 49/488 X |
| 3,750,333 | 8/1973 | Vance | 49/488 X |
| 3,869,873 | 3/1975 | Thomas | 49/478 X |
| 4,305,230 | 12/1981 | Gerrison | 49/478 X |
| 4,441,301 | 4/1984 | Benson | 49/488 X |
| 4,653,819 | 3/1987 | Swerbinsky | 49/478 X |
| 4,818,043 | 4/1989 | Borgen . | |
| 4,820,885 | 4/1989 | Lindsay . | |
| 4,831,780 | 5/1989 | Bockwinkel . | |
| 4,832,396 | 5/1989 | Morenko et al. . | |
| 4,852,303 | 8/1989 | Rolek . | |
| 4,878,368 | 11/1989 | Toutant et al. . | |
| 4,882,821 | 11/1989 | Sims, Jr. . | |
| 4,891,626 | 1/1990 | Neuman . | |
| 4,891,912 | 1/1990 | Bockwinkel . | |
| 4,912,359 | 3/1990 | Offutt et al. . | |
| 4,916,864 | 4/1990 | Thompson . | |
| 4,922,658 | 5/1990 | Coddens . | |
| 4,932,730 | 6/1990 | Zeismann et al. . | |
| 4,941,289 | 7/1990 | Rolek . | |
| 4,947,584 | 8/1990 | Wexler . | |
| 4,947,585 | 8/1990 | Guetle, Jr. . | |
| 4,960,254 | 10/1990 | Hartke . | |
| 4,967,511 | 11/1990 | Werginz et al. . | |
| 4,974,366 | 12/1990 | Tizzoni . | |
| 4,977,705 | 12/1990 | Guetle, Jr. . | |
| 4,996,793 | 3/1991 | Mazur . | |
| 4,999,951 | 3/1991 | Keys et al. . | |

*Primary Examiner*—Peter M. Cuomo
*Assistant Examiner*—Jerry Redman
*Attorney, Agent, or Firm*—Harness, Dickey & Pierce

[57] ABSTRACT

A retainer and seal gasket is disclosed for a thermally insulated cabinet having a door. The configuration reduces the gap between the door and cabinet, and eliminates exposure of metal components to the cabinet interior. The retainer clamps the shell and liner of the container together without requiring separate mechanical fasteners. The retainer clips onto the shell and liner of the cabinet. The retainer further has a fastening means for securing the retainer and the seal gasket in an interlocking relationship. The retainer may include at least one anchoring rib for affixing the retainer within insulation inserted between the shell and liner of the container. The seal gasket provides a flexible bumper and a magnetic seal for releasably closing the door of the cabinet.

24 Claims, 4 Drawing Sheets

REFRIGERATOR GASKET AND RETAINER

BACKGROUND OF THE INVENTION

The present invention relates to refrigerators, freezers and other thermally insulated containers, provided with one or more doors adapted to close and access opening of the container. In particular, the present invention relates to a retainer and seal gasket for use in assembling the shell and liner portions of the container without separate mechanical fasteners, such as screws or rivets.

A refrigerator is generally a cabinet constructed of a metal outer shell, an injection molded or vacuum formed plastic liner, insulation, and a means for assembling and fastening these elements. This fastening means is generally a metal clip, which provides a conductive heat transfer path from the exterior to the interior of the cabinet, resulting in energy loss. The refrigerator door typically has an elastic magnetic seal gasket for releasably closing the container. Numerous techniques and devices for assembling the components of a refrigerator are known in the art. These techniques generally involve multiple pieces as well as separate mechanical fasteners. The use of these separate fasteners often requires numerous holes to be drilled. As a result, assembly of the refrigerator is a complicated, multiple-step operation, and results in low repeatability, high cost, and flaws in manufacture.

Although these conventional methods of attaching the refrigerator and door components have been acceptable in the art thus far, it is desirable to provide a simple retainer and gasket to fasten the shell and liner portions of the refrigerator.

SUMMARY OF THE INVENTION

The present invention provides a gasket assembly, including a retainer and seal gasket, for use in more easily assembling the shell and liner of a thermally insulated cabinet. No separate mechanical fasteners are required. The gasket assembly is installed on the cabinet, rather than on the door. The gasket assembly is constructed of plastic, which eliminates exposure of metal to the interior of the cabinet, reducing energy loss. In addition, the invention accommodates a reduced gap between the door and cabinet than was previously known in the art. This narrower gap further prevents heat flow and energy loss.

The retainer is constructed with a base, two side walls, and two retaining lips forming a first and second slot to accept the edges of the outer shell of the cabinet and the inner liner of the cabinet, respectively. The retainer also has flanges and backstop ribs forming two chambers for receiving two flexible darts formed on the seal gasket. The retainer is further constructed of at least one support member for supporting a sleeve formed on the gasket for holding a magnet. The seal gasket is symmetrical, and has a magnet and sleeve, two flexible webs, two bumper portions, two flaps, two flexible darts, and two platforms. At least one anchoring rib is attached to the base and extends into the insulation of the cabinet, preventing removal of the retainer from the edge of the cabinet.

The present invention further provides an alternative embodiment, wherein the retainer is formed with a horizontal base portion which also supports the gasket, replacing the support means. The seal gasket is formed with only one bumper and two flexible webs supporting the sleeve and magnet.

It is an object of the present invention to provide a gasket assembly for use in assembling a refrigerator cabinet.

It is a further object of the present invention to provide a retainer and gasket which fasten the elements of a thermally insulated container without the need for separate fasteners.

It is a further object of the present invention to provide a means for releasably closing the door of a thermally insulated container while maintaining only a small gap between the container and door components.

These and other advantages and features will become apparent from the following description and claims in conjuction with the accompanying drawings.

DETAILED DESCRIPTION OF THE PREFERRED EMBODIMENT

Figure 1:
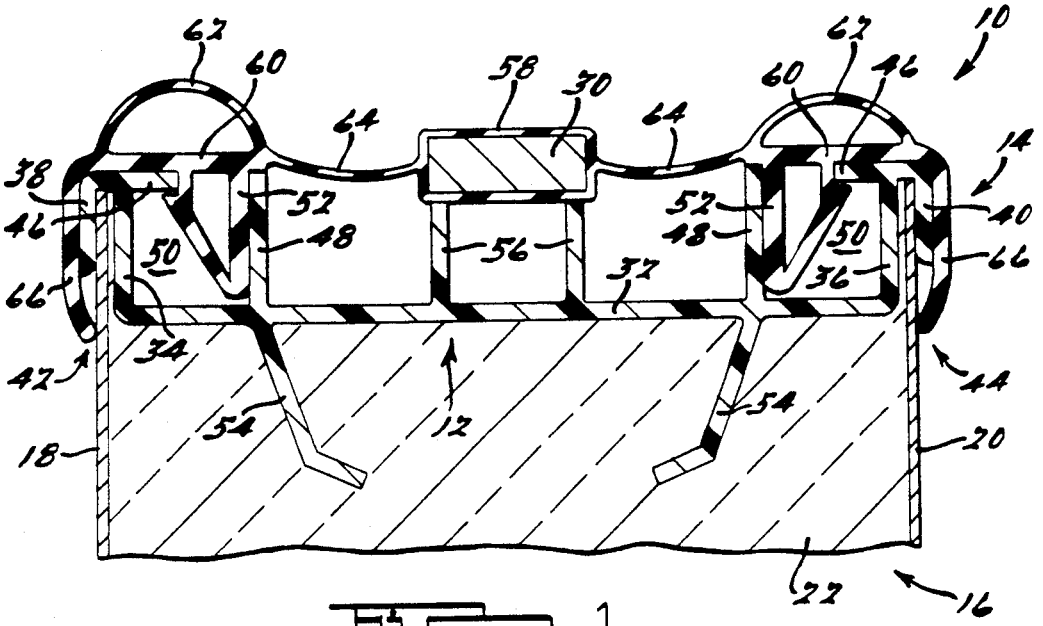
FIG. 1 is a sectional view of the retainer and gasket according to the present invention.
Figure 2:
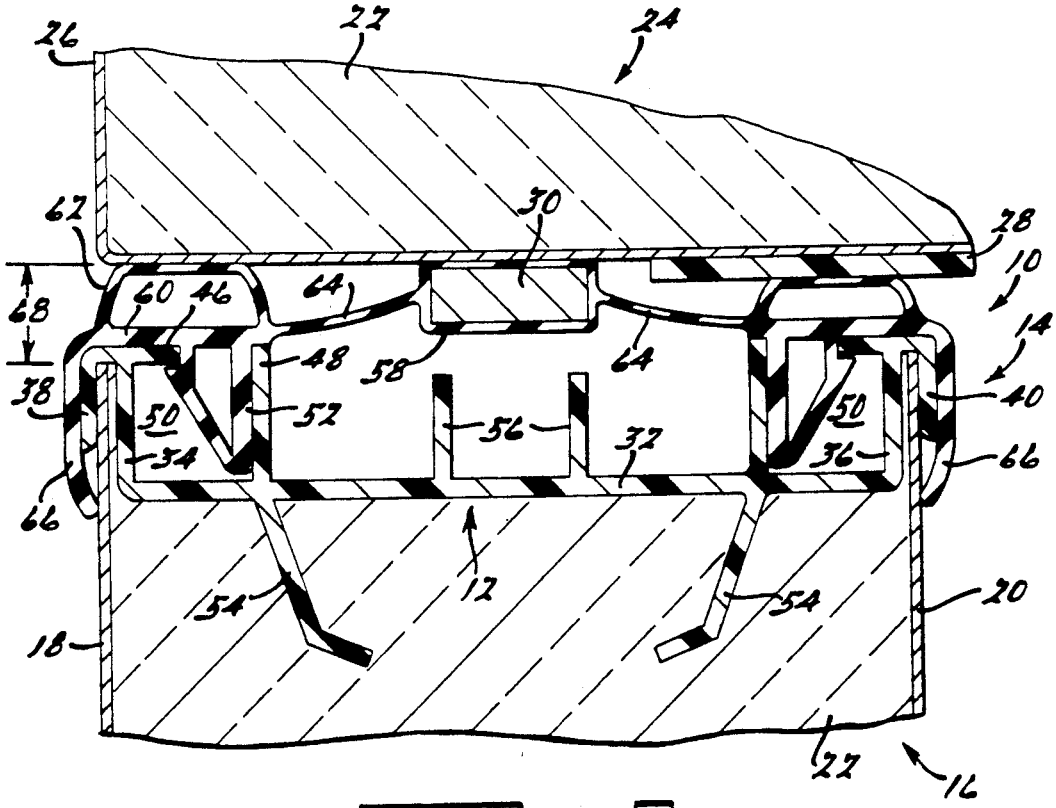
FIG. 2 is a sectional view of the retainer and gasket of the present invention, showing the door when closed.

With reference to the drawings, FIG. 1 shows the gasket assembly 10 of the present invention, consisting of a retainer 12 and gasket seal 14. The gasket assembly 10 is shown as installed in a thermally insulated container 16, such as a refrigerator, which is composed of an outer shell 18 and an inner liner 20. Insulation 22 is inserted into the volume defined by the outer shell 18 and the inner liner 20. The door 24 to the refrigerator is constructed in a similar manner as the cabinet 16, including an outer door shell 26 and an inner door liner or pan 28. Generally, the shell portions 18,26 of the cabinet 16 and door 24 are made of metal, whereas the inner liners 20,28 are made of injection molded plastic. The refrigerator cabinet 16 is assembled by means of a retainer 12 and a seal gasket 14. The elongated, extruded retainer and gasket 14 surround the perimeter of the edge of the refrigerator cabinet 16. As is now known in the art, the seal gasket 14 contains a magnet 30 which releasably maintains the door 24 in a closed position and allows the door 24 to be periodically opened.

In particular, as seen in FIG. 1, gasket assembly 10 includes an elongated extrusion gasket 14 and elongated extrusion retainer 12. The retainer 12 is constructed primarily of a base 32 which extends across the distance between the cabinet shell 18 and liner 20. First and second side walls 34,36 are affixed perpendicular to the base 32 at opposite ends. The outermost extending ends of the side walls 34,36 are constructed with a first and second retaining lip 38,40 which each form a slot 42,44, in conjunction with the respective adjacent side wall 34,36, for insertion of the metal outer cabinet shell 18 and the plastic inner cabinet liner 20. The retainer 12 has two flanges 46 and backstop ribs 48 which form two chambers 50 for receiving flexible darts 52 formed on the gasket seal 14. The flanges 46 engage the darts 52 while the backstop ribs 48 prevent removal of the darts 52, and as a result the gasket 14, from the retainer 12. The retainer 12 has at least one anchoring rib 54 which extends from the inner surface of the retainer 12 into the insulation 22 which fills the cavity between the cabinet outer shell 18 and inner liner 20. The retainer 12 further has at least one supporting member 56 which supports a rectangular sleeve 58 and an enclosed magnet 30 of the flexible gasket seal 14.

Figure 3:
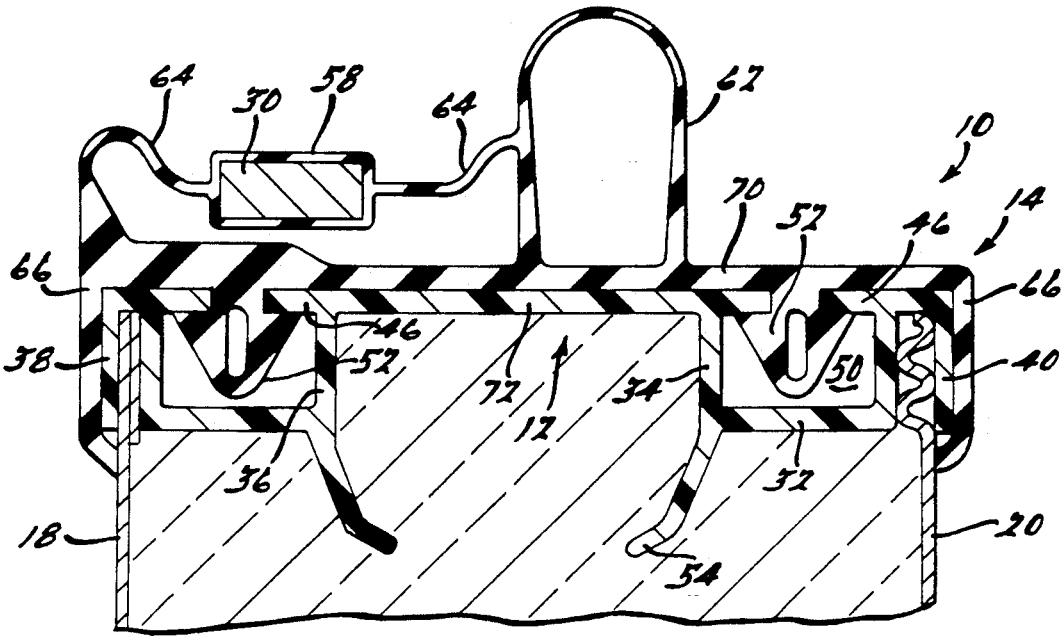
FIG. 3 is a sectional view of first alternative embodiment of the invention.
Figure 4:
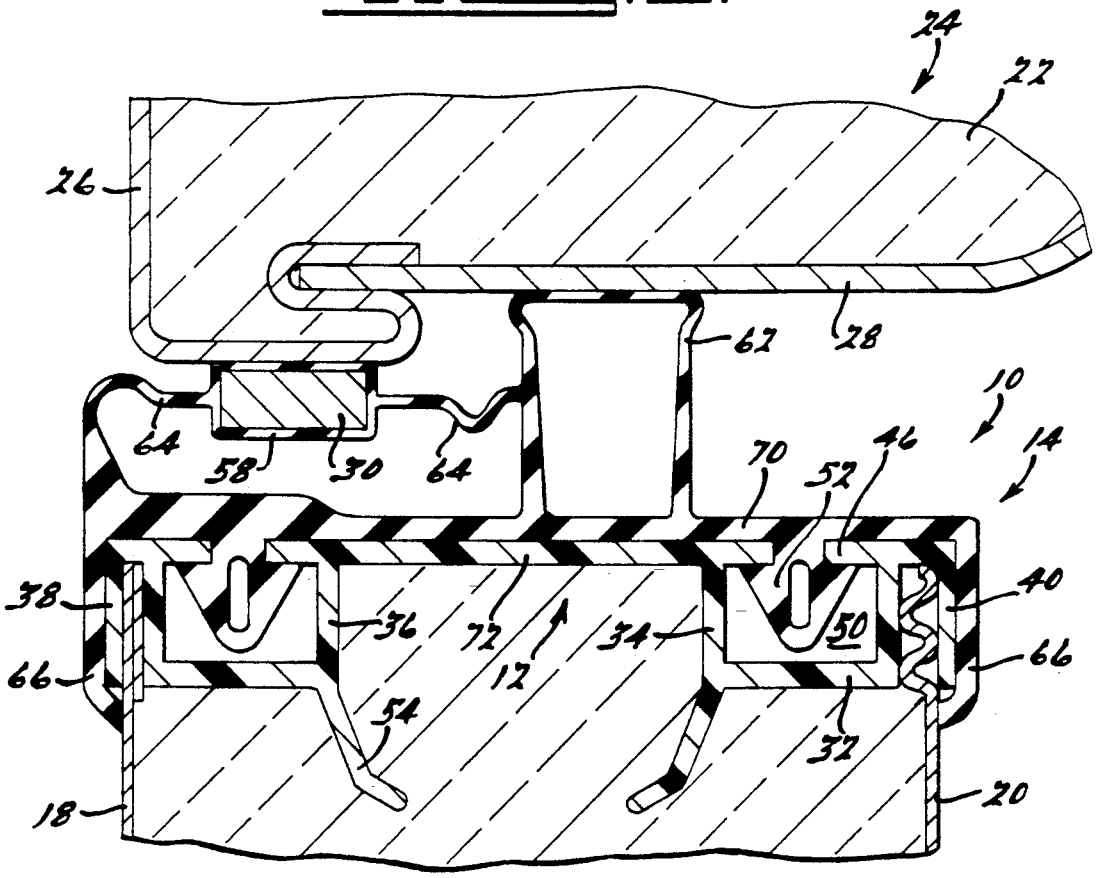
FIG. 4 is a sectional view of a first alternative embodiment of the invention, showing the door when closed.

The gasket seal 14 is constructed of two flexible darts 52 which are adapted to be received within chambers 50 formed on the retainer 12. In the preferred embodiment, these darts 52 are formed as half-darts 52, having one perpendicular wall and one angled wall with one interlocking shelf. Half-darts 52 may be used in more narrow areas than conventional double-sided darts 52, as shown in FIGS. 3 and 4. The gasket 14 has dual platforms 60 which rest on the flanges 46 of the retainer 12. Two door bumpers 62 are affixed to the platforms 60 and provide a flexible, shock absorbing contact for the door components 26,28. Two flexible webs 64 are attached to the ends of the platforms 60 and bumpers 62. These webs 64 support a rectangular sleeve 58 which encompasses a magnet 30. The flexible webs 64 allow motion of the sleeve 56 and magnet 30 away from the toward the retainer 12. The gasket seal 14 is further formed with two outer flaps 66 which cover the outer retaining lips 38,40 of the retainer 12, hide the retainer 12, and create a visually pleasing interface between the cabinet 16 and the gasket assembly 10.

Gasket seal 14 creates a magnetic seal between the door 24 and the cabinet 16 by means of the magnet 30. Force exerted to open the door 24 stretches the flexible webs 64 and urges the gasket 14 away from the retainer 12 until the magnetic seal is broken. The darts 52 formed on the gasket seal 14 resist being withdrawn from the chambers 50 by reason of the large size of the base of the darts 52 relative to the size of the openings to the chambers 50. When the door 24 is opened, the magnet 30 and surrounding sleeve 58 rests on the support members 56 of the retainer 12. When the door 24 is closed, the magnet 30 is attached to the metal door shell 26, and the magnet 30 and sleeve 58 no longer contact the support members 56 but raise into contact with the door shell 26.

The space between the cabinet outer shell 18 and liner 20, as well as the space between the door shell 26 and liner 28, is shown as completely filled with insulation 22, such as would result from inserting a foamable plastic insulation 22 within the interior of the door 24 and cabinet 16, and causing the material to foam and harden within the respective shells 18,26 and liners 20,28. Alternatively, insulation 22 may be provided by glass fiber batting 22 that is pressed against the inside of the door 24 and cabinet 16.

The configuration of the retainer 12 and gasket seal 14 allows for an exceedingly small gap 68 between the door 24 and cabinet 16 components, as compared to what is previously known in the art. This narrower gap 68 prevents heat flow and energy loss. In addition, the gasket assembly 14 is constructed of plastic, which eliminates exposure of metal to the interior of the cabinet 16, further reducing energy loss.

In assembling the retainer 12 and gasket 14, the retainer 12 fits onto the shell 18 and liner 20 of the cabinet 16 as shown in FIG. 1. Elongated segments of the retainer 12 are attached to the opening in the cabinet's outer shell 18 and liner 20, so as to form a frame around the perimeter of the opening to the cabinet 16. If the insulation 22 is provided by fiberglass batting, then it will already be in place before the liner 20 is installed into the body of the cabinet 16. If the insulation 22 is foamed in place, then the foamable mixture will be injected into the cabinet 16 after assembly of the shell 18, liner 20, and retainer 12. The gasket seal 14 is then snapped into the retainer 12 by forcing the darts 52 into the chambers 50. As a result, assembly of the refrigerator cabinet 16 is a simple three step process, consisting of pushing the retainer 12 onto the cabinet shell 18 and liner 20, filling the cabinet 16 with insulation 22, and pushing the gasket 14 onto the retainer 12.

An alternative embodiment of the present invention is shown in FIGS. 3 and 4. The seal gasket 14 is formed with a laterally extending base 70. Two flaps 66 are affixed perpendicular to the ends of the base 70. The seal gasket 14 is constructed with one flexible door bumper 62 and two double-sided flexible darts 52. A rectangular sleeve 58 surrounds the magnet 30. The sleeve 58 is supported on both lateral sides by flexible webs 64 which are attached to the door bumper 62 and base 70. The darts 52 are each inserted between two flanges 46 on the retainer 12. A laterally extending support member 72 extends between the inner flanges 46. Each dart 52 is received within a chamber 50 formed on the retainer 12 which is constructed of two side walls 34,36 and a base portion 32. The retainer 12 is constructed with two retaining lips 38,40 as set forth above. At least one anchoring rib 54 is formed onto the corner where the base portions 32 meet the inner side walls 34,36. As in the preferred embodiment, when the door 24 is closed the door bumper 62 compresses and the magnet 30 is attached to the door shell 26.

Figure 5:
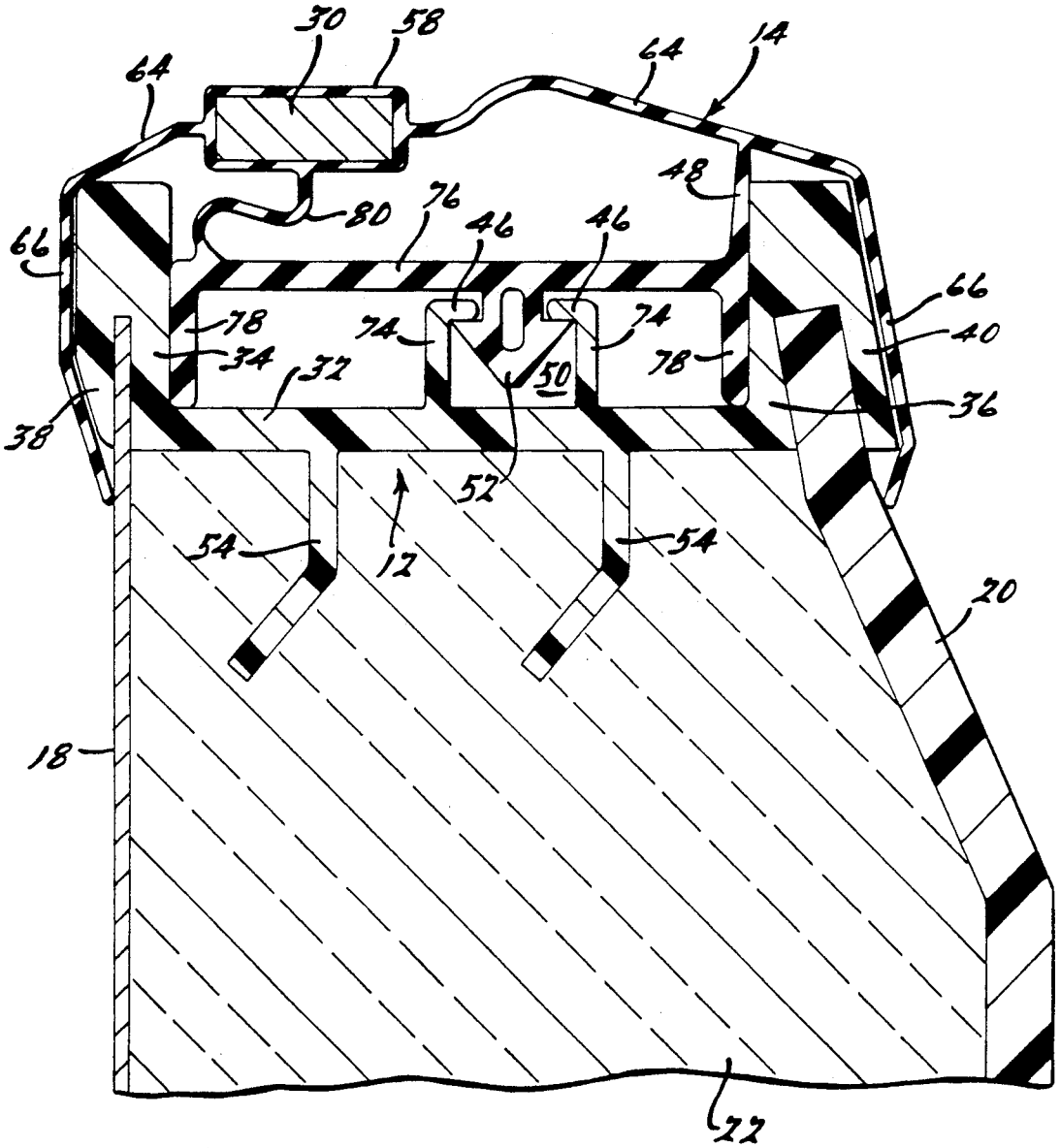
FIG. 5 is a sectional view of a second alternative embodiment of the invention.

A second alternative embodiment is depicted in FIG. 5. The retainer 12 is constructed substantially similar to that shown in FIGS. 1 and 2, except that one central chamber 50 is formed by parallel extending chamber walls 74 and transverse flanges 46, for accepting a flexible dart 52 formed on the gasket 14. The retainer has side walls 34,36, retaining lips 38,40 and anchoring ribs 54 as in FIGS. 1 and 2. The gasket seal 14 is constructed of a laterally extending platform or base 76, a flexible dart 52, a side wall 48, and two parallel lower legs 78 which support gasket 14 on the base 32 of retainer 12. Gasket seal 14 is also formed with two side flaps 66, two flexible webs 64, a rectangular sleeve 58 surrounding a magnet 30, as well as a flexible central sleeve support web 80. The flexible webs 64, in conjunction with sleeve support web 80 and side wall 48, act in replacement of and in a similar manner as bumper 62, as shown in FIGS. 1 through 4.

Figure 6:
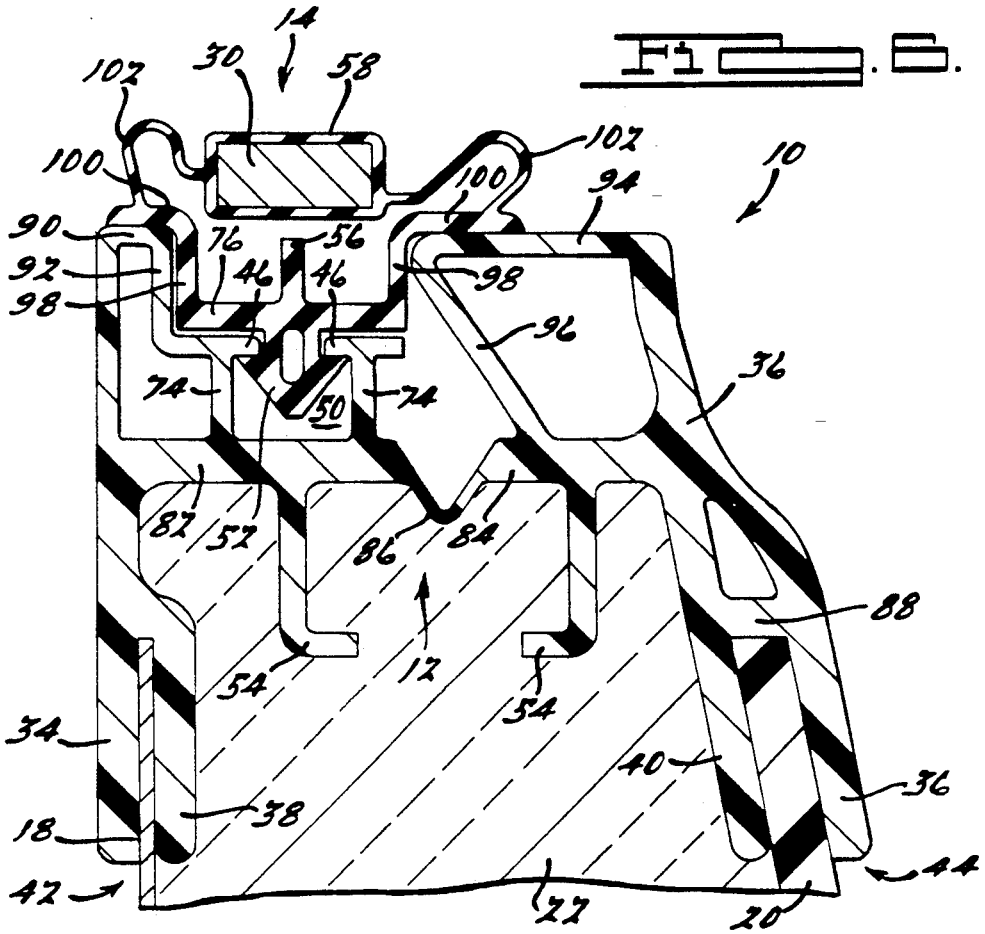
FIG. 6 is a sectional view of a third alternative embodiment of the invention.

A third alternative embodiment is shown in FIG. 6. The retainer 12 is formed having first and second base portions 82,84 which are connected by a V-shaped portion 86 operative to adjust the width of retainer 12, a first and second side wall 34,36 and first and second retaining lips 38,40 which form a first and second slot 42,44 for accepting and holding a cabinet outer shell 18 and a cabinet inner liner 20, respectively. Retainer 12 has a stop surface 88 for positioning inner liner 20. Anchoring ribs 54 depend from the first and second base portions 82,82, respectively, and extend into insulation 22. First side wall 34 ends in a first plateau 90, which continues into an interior side wall 92, which is supported by chamber wall 74. Second side wall 36 ends in a second plateau 94, which is supported by a reinforcing member 96. Chamber walls 74 and first base 82 form chamber 50 for accepting dart 52 in interlocking relationship with flanges 46.

Gasket 14 is formed with a gasket base 76, gasket side walls 98, platforms 100, a support member 56, webs 102 which also act as bumpers for the door elements, and a sleeve 58 which carries a magnet 30. Webs 102 extend between platforms 100 and support sleeve 58.

Figure 7:
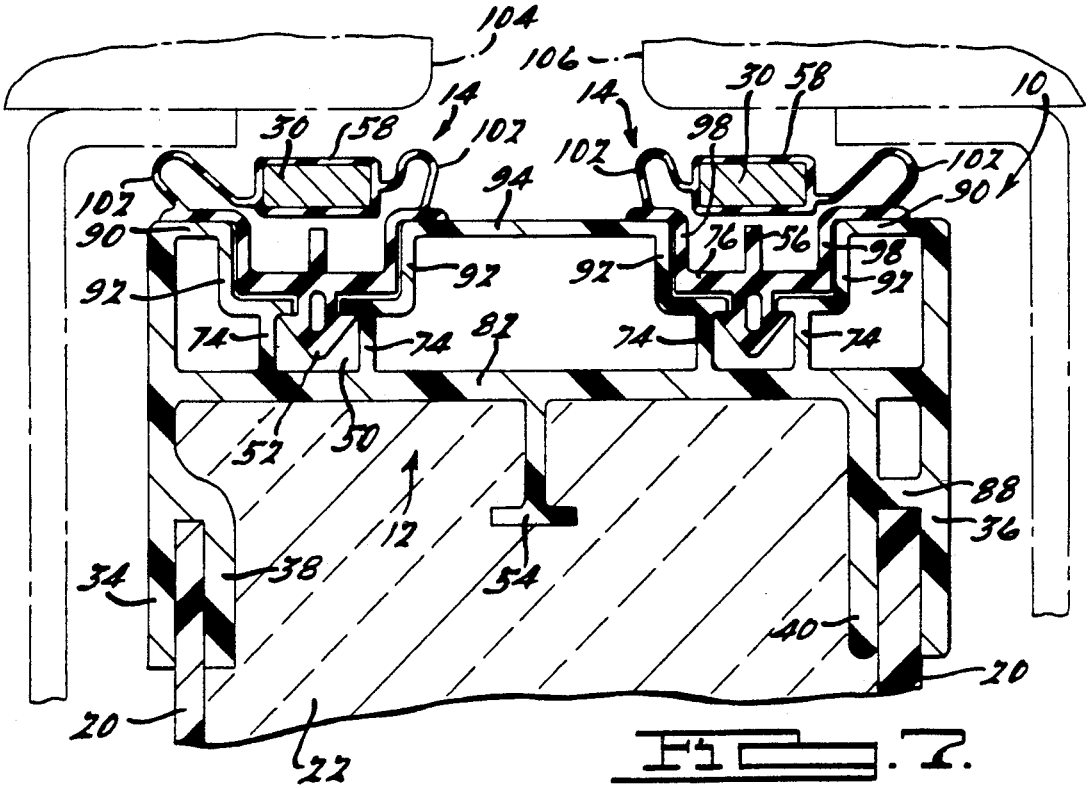
FIG. 7 is a sectional view of a fourth alternative embodiment of the invention.

FIG. 7 shows a fourth alternative embodiment. Retainer 12 is constructed substantially similar to that shown in FIG. 6, except that it is formed to retain two gaskets 14 rather than one. Gasket 14 is constructed in the same manner as that shown in FIG. 6. This embodiment may be used for the cabinet partition between a refrigerator door 104 and a freezer door 106, where each gasket 14 magnetically releasably closes each door 104,106 independently.

It should be understood that various modifications of the preferred embodiment will become apparent to those skilled in the art after a study of the specification, drawings, and the following claims.

What is claimed is:

1. A gasket assembly, comprising:

a retainer and a gasket;

said retainer having a base elongated in a longitudinal direction and extending in a lateral direction, a first fastening means having a first channel for accepting a portion of a shell of a cabinet and thereby securing said retainer to said shell, a second fastening means having a second channel for accepting a portion of a liner of said cabinet and thereby securing said retainer to said liner, a third fastening means for securing said retainer and said gasket in an interlocking relationship, said first and second channels being oriented in a first direction and a second direction, each of said first and second directions being substantially perpendicular to said longitudinal and said lateral directions; and said gasket having at least one platform elongated in a longitudinal direction and extending in a lateral direction, at least one flexible bumper attached to said platform and for contacting a portion of a door, and a magnetic fastening means attached to said platform and for releasably securing said door to said cabinet in a closed position, said magnetic fastening means defining a first planar surface adapted to contact a second planar surface in flush engagement when said door is in said closed position, said bumper being spaced laterally apart from said magnetic fastening means.

2. The gasket assembly as set forth in claim 1, said retainer having at least one anchoring rib extending away from said base of said retainer.

3. The gasket assembly as set forth in claim 2, said cabinet further comprising insulation material inserted between said cabinet shell and cabinet liner, said anchoring rib extending into said insulation so as to prevent removal of said retainer from said cabinet shell and said cabinet liner and to prevent lateral movement of said retainer.

4. The gasket assembly as set forth in claim 1, said retainer having a first and second side wall and a first and second retaining lip, said side walls and said retaining lips cooperating to form said first and second fastening means.

5. The gasket assembly as set forth in claim 4, wherein said first retaining lip is biased toward said first side wall such that said first retaining lip and said first side wall provide a clip that grips said cabinet shell.

6. The gasket assembly as set forth in claim 4, wherein said second retaining lip is biased toward said second side wall such that said second retaining lip and said second side wall provide a clip that grips said cabinet liner.

7. The gasket assembly as set forth in claim 1, said retainer forming a chamber for receiving a portion of said gasket in interlocking relationship.

8. The gasket assembly as set forth in claim 1, said gasket having at least one side flap extending beyond said retaining lip of said retainer.

9. The gasket assembly as set forth in claim 1, wherein said third fastening means is formed of at least one flange formed on said retainer and a dart formed on said gasket having at least one interlocking surface for interlocking with said flange.

10. A gasket assembly comprising:

a retainer and a gasket;

said retainer having a base elongated in a longitudinal direction and extending in a lateral direction, a first fastening means having a first channel for accepting a portion of a shell of a cabinet and thereby securing said retainer to said shell, a second fastening means having a second channel for accepting a portion of a liner of said cabinet and thereby securing said retainer to said liner, a third fastening means for securing said retainer and said gasket in an interlocking relationship, and at least one anchoring rib extending away from said base of said retainer whereby said first and second channels are perpendicular to said longitudinal and lateral directions; and said gasket having at least one platform elongated in a longitudinal direction and extending in a lateral direction, at least one flexible bumper for contacting a portion of a door, and a magnetic fastening means for releasably securing said door to said cabinet in a closed position, said cabinet having insulating material between said shell and said liner, said anchoring rib extending into said insulating material to resist removal of said retainer from said cabinet.

11. The gasket assembly as set forth in claim 10, said retainer having at least one support member for supporting said magnetic fastening means in at least one position of said magnetic fastening means.

12. The gasket assembly as set forth in claim 10, said gasket having at least one side flap extending beyond said retaining lip of said retainer.

13. The gasket assembly as set forth in claim 10, wherein said first retaining lip is biased toward said first side wall such that said first retaining lip and said first side wall provide a clip that grips said cabinet shell.

14. The gasket assembly as set forth in claim 10, wherein said second retaining lip is biased toward said second side wall such that said second retaining lip and said second side wall provide a clip that grips said cabinet liner.

15. The gasket assembly as set forth in claim 10, said retainer having at least one flange and said gasket having at least on interlocking surface for interlocking with and thereby affixing to said retainer.

16. A gasket assembly, comprising:

a retainer and a gasket;

said retainer having a base elongated in a longitudinal direction and extending in a lateral direction, said base having first and second laterally opposing ends;

said retainer having a first and second side wall affixed to said first and second opposite ends of said base, said first and second side walls extending in a substantially vertical direction, said vertical direction being oriented perpendicular to said longitudinal and said lateral directions;

said retainer having first and second retaining lips affixed to said first and second side walls and extending in a direction substantially parallel to said side walls, said first side wall and first retaining lip forming a first slot for receiving and gripping an edge of a shell of a cabinet, said second side wall and second retaining lip being formed to define a second slot for receiving and gripping an edge of a liner of said cabinet;

said retainer having at least one chamber formed on said retainer for receiving a portion of said gasket in interlocking relationship;

said gasket having at least one platform elongated in a longitudinal direction and extending in a lateral direction, at least one flexible dart attached to said platform and for inserting into said chamber formed on said retainer in an interlocking relationship, at least one webbed portion attached to said platform and an elongated sleeve attached to said platform, said web being formed to connect said platform and said sleeve, said sleeve formed to surround and accept a magnet, said web forming a flexible bumper for contacting a portion of a door when said door is in a closed position;

said gasket and retainer being formed to provide a magnetic fastening means for releasably securing said door to said cabinet in said closed position.

17. The gasket assembly as set forth in claim 16, said retainer having at least one anchoring rib extending away from said base of said retainer.

18. The gasket assembly as set forth in claim 17, said door further comprising insulation material inserted between said cabinet shell and cabinet liner, said anchoring rib extending into said insulation so as to prevent removal of said retainer from said cabinet shell and said cabinet liner and to prevent lateral movement of said retainer.

19. The gasket assembly as set forth in claim 16, said retainer having at least one support member for supporting said sleeve and said magnet formed on said gasket in at least one position of said sleeve and said magnet.

20. The gasket assembly as set forth in claim 16, said gasket having at least one side flap extending beyond said retaining lip of said retainer.

21. The gasket assembly as set forth in claim 16, wherein said first retaining lip is biased toward said first side wall such that said first retaining lip and said first side wall provide a clip that grips said cabinet shell.

22. The gasket assembly as set forth in claim 16, wherein said second retaining lip is biased toward said second side wall such that said second retaining lip and said second side wall provide a clip that grips said cabinet liner.

23. The gasket assembly as set forth in claim 16, said retainer having at least one flange and said gasket having at least one interlocking surface for interlocking with and thereby affixing to said retainer.

24. The gasket assembly as set forth in claim 16, said base having a flexible means for adjusting the lateral width of said retainer.

* * * * *